US012084930B2

(12) United States Patent
Faul et al.

(10) Patent No.: US 12,084,930 B2
(45) Date of Patent: Sep. 10, 2024

(54) ASYMMETRIC RELEASE DEVICE, METHOD, AND SYSTEM

(71) Applicants: Ryan Faul, Houston, TX (US); Marcelle H. Hedrick, Kingwood, TX (US); Jonathan Hanson, Houston, TX (US)

(72) Inventors: Ryan Faul, Houston, TX (US); Marcelle H. Hedrick, Kingwood, TX (US); Jonathan Hanson, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 127 days.

(21) Appl. No.: 17/885,916

(22) Filed: Aug. 11, 2022

(65) Prior Publication Data

US 2024/0052715 A1 Feb. 15, 2024

(51) Int. Cl.
*E21B 23/00* (2006.01)

(52) U.S. Cl.
CPC ..... *E21B 23/00* (2013.01)

(58) Field of Classification Search
CPC ..... E21B 23/00
See application file for complete search history.

(56) References Cited

U.S. PATENT DOCUMENTS

| | | | | |
|---|---|---|---|---|
| 3,268,239 | A * | 8/1966 | Castor | E21B 33/043 285/306 |
| 3,507,325 | A * | 4/1970 | Scott | E21B 33/165 166/70 |
| 3,948,322 | A * | 4/1976 | Baker | E21B 33/127 166/187 |
| 9,109,407 | B2 * | 8/2015 | Inglis | E21B 41/00 |
| 9,657,532 | B2 * | 5/2017 | Stokes | E21B 17/06 |
| 10,738,542 | B2 * | 8/2020 | Adam | E21B 17/021 |
| 2010/0232887 | A1 * | 9/2010 | Parsons | E02D 7/28 285/3 |

* cited by examiner

*Primary Examiner* — Jonathan Malikasim
(74) *Attorney, Agent, or Firm* — CANTOR COLBURN LLP

(57) ABSTRACT

An asymmetric release configuration including a projection, a recess receptive to the projection the recess having a first shoulder that when brought into contact with the projection in a first direction loads the projection in a first way that results in a first release threshold, and a second shoulder that when brought into contact with the projection in a second direction loads the projection in a second way that results in a second release threshold, the second release threshold being different than the first release threshold. A method for operating a borehole including running a configuration into a borehole to a target depth, resisting a load on the configuration in a first direction to a first release threshold, and resisting a load in another direction to a second release threshold different than the first release threshold.

18 Claims, 9 Drawing Sheets

ASYMMETRIC RELEASE DEVICE, METHOD, AND SYSTEM

BACKGROUND

In the resource recovery and fluid sequestration industries there is often a need to actuate devices at different times. Release devices with a known threshold for release are commonly employed to actuate operations in a desired timeline. These tend to increase control over the borehole and are therefore desirable. The art is always receptive to novel concepts that improve control.

SUMMARY

An embodiment of an asymmetric release configuration including a projection, a recess receptive to the projection the recess having a first shoulder that when brought into contact with the projection in a first direction loads the projection in a first way that results in a first release threshold, and a second shoulder that when brought into contact with the projection in a second direction loads the projection in a second way that results in a second release threshold, the second release threshold being different than the first release threshold.

An embodiment of a borehole system including a borehole in a subsurface formation, a configuration disposed in the borehole.

An embodiment of a method for operating a borehole including running a configuration into a borehole to a target depth, resisting a load on the configuration in a first direction to a first release threshold, and resisting a load in another direction to a second release threshold different than the first release threshold.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

An asymmetric release configuration is disclosed herein that facilitates a first threshold for release in a first direction and a second different threshold for release in a second direction. The concept allows for tailoring of operations in a borehole or otherwise. Perhaps set down weight is less than potential load in overpull in a particular example, perhaps it is important for the particular application that actuations be carried out in both directions but the thresholds need to be different. The release configuration disclosed herein enables such a system using a projection, which may be a boss, a flange (annular or part annular and one or more of those), or another geometric shape. A recess is receptive to the projection the recess having a first shoulder that when brought into contact with the projection in a first direction loads the projection in a first way that results in a first release threshold and a second shoulder that when brought into contact with the projection in a second direction loads the projection in a second way that results in a second release threshold, the second release threshold being different than the first release threshold. This is the case for one or more projections and one or more recesses. The concept allows for many different load thresholds for release.

Figure 1:
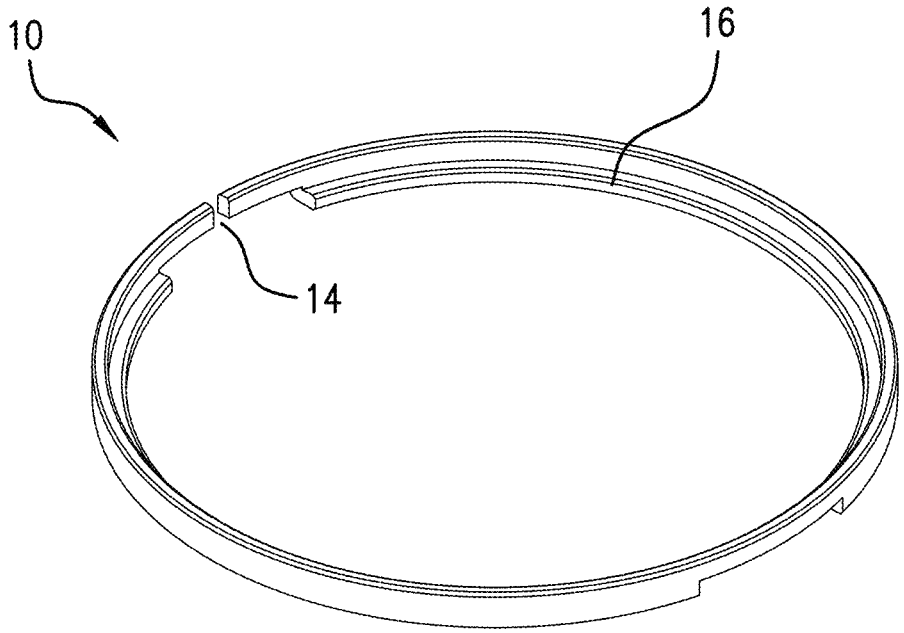
FIG. 1 is a perspective view of a body of an asymmetric release configuration as disclosed herein.
Figure 2:
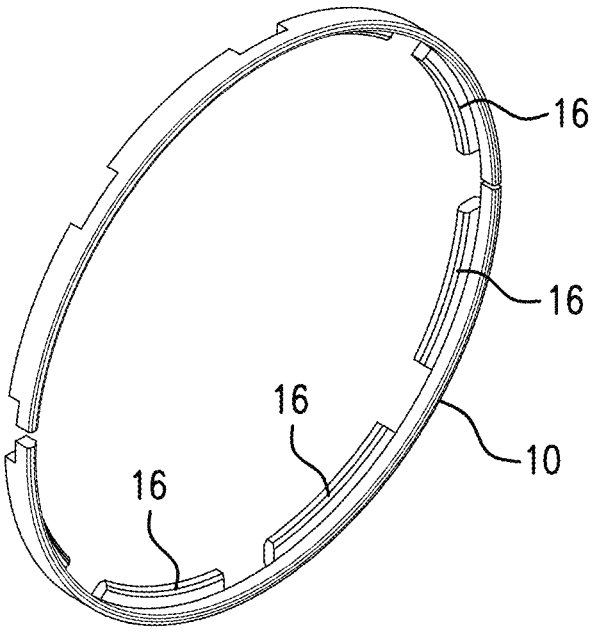
FIG. 2 is a perspective view of the body of FIG. 1 showing multiple projections.
Figure 3:
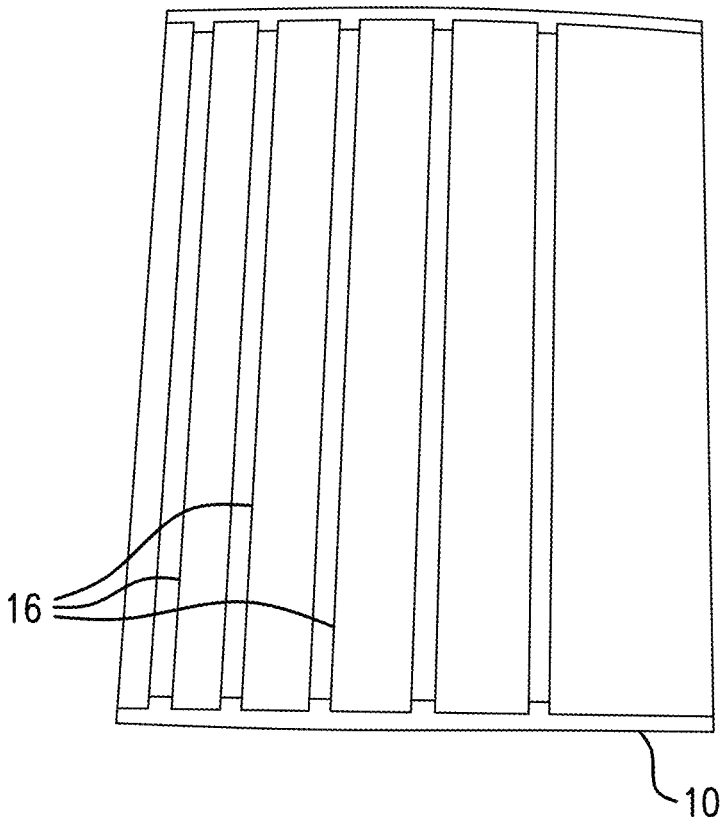
FIG. 3 is a cross section view of a body with multiple projections in a longitudinal layout.

Referring to FIG. 1, one example of the asymmetric release configuration is illustrated. A body 10 that makes up a part of an asymmetric release configuration 12 (see FIG. 2) is illustrated alone. The body 10 may be circumferentially complete or may have one or more breaks therein, one break 14 being illustrated in FIG. 1. While the body is illustrated as a tubular construction it is important to understand that the concept as disclosed herein is not limited to tubular forms but could be a module attached to a tubular form or any other form. Depending from the body 10 is a projection 16 that extends from the body 10. In some cases and as illustrated, the projection 16 extends radially inwardly. Extension direction could be generally outwardly or generally inwardly from the body 10, depending upon particular construction. While two projections are shown in FIG. 1, one or more are contemplated. See FIG. 2 for a larger number of projections. Also, it is to be understood that each projection may be the same in geometrical dimensions or may be different. This merely provides for greater tailorability of threshold releases. The projections may also be located at more than one at different longitudinal length positions along the body 10, see FIG. 3.

Figure 4:
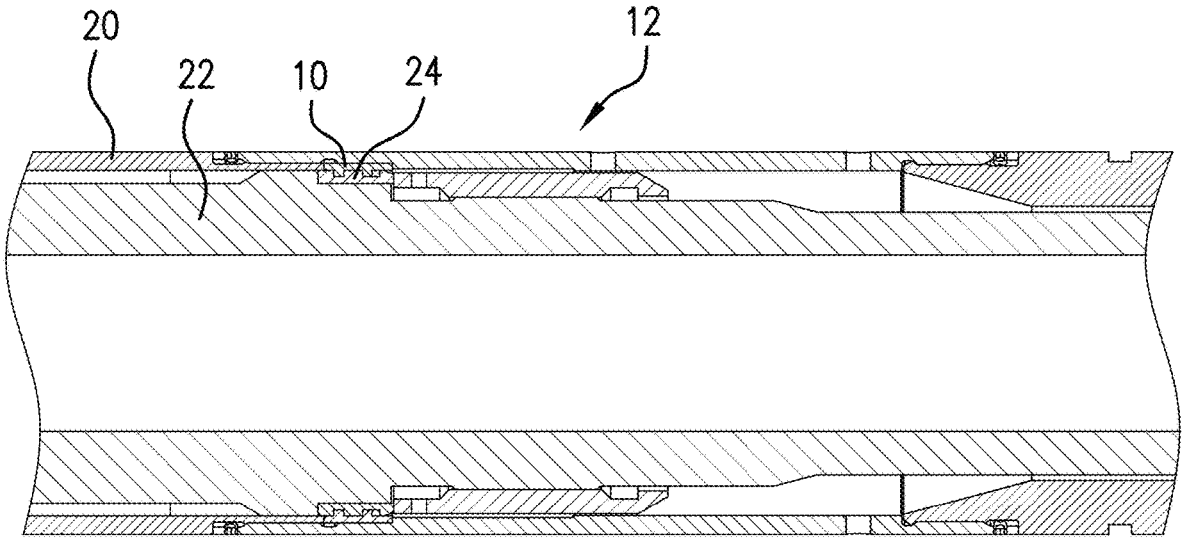
FIG. 4 is a cross sectional view of the asymmetric release device that employs the body of FIG. 1.
Figure 5:
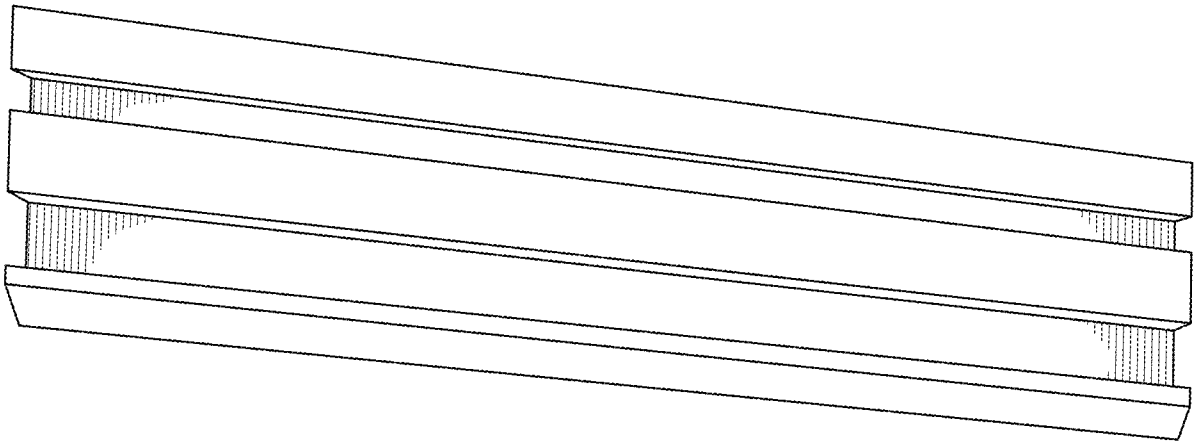
FIG. 5 is a view of an insert with two recesses.
Figure 6:
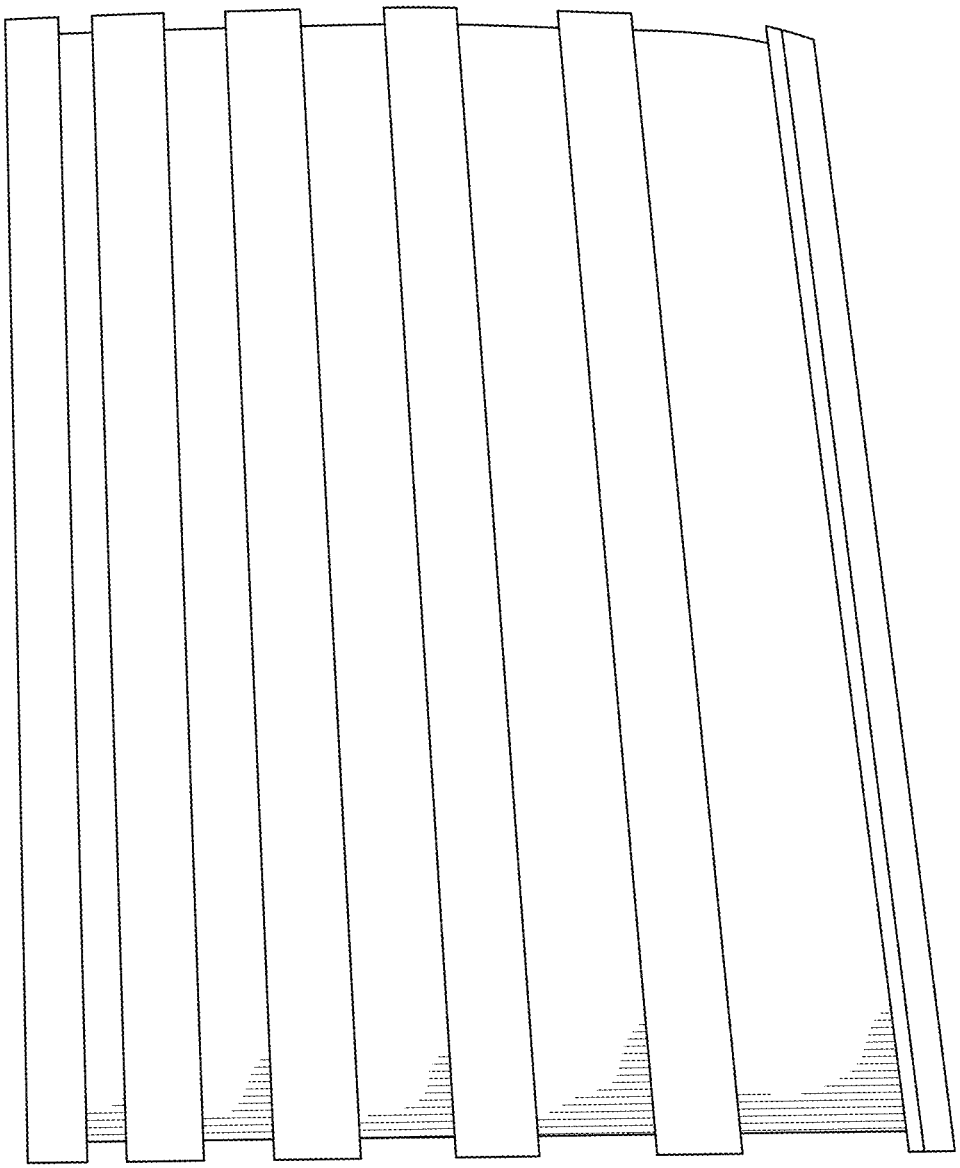
FIG. 6 is a view of an insert with multiple recesses in a longitudinal layout.

Referring to FIG. 4, an embodiment of the configuration 12 is illustrated in cross section. Configuration 12 includes a housing 20 and a mandrel 22 and in an embodiment the body 10 resides therebetween. It is also noted that in order to increase modularity, it is in some embodiments desirable to have an insert for the mandrel 22, the housing 20 or both that will engage the body 10 rather than directly machining the mandrel 22, housing 20 or both to have features that will engage the body 10 or would directly engage each other. An insert 25 having recesses can be seen in FIGS. 5 and 6, illustrating 2 and 5 recesses, respectively. No limitation in number of recesses is intended. In the illustration of FIG. 4, the mandrel 22 is shown with an insert 24. The scale of FIG. 4 does not permit direct understanding of the configuration 12 without first reference to FIGS. 7 and 8(A,B) discussed hereunder but for FIG. 4 it will be appreciated that mandrel 22 and housing 20 are longitudinally moveable relative to one another. That motion, which is quite familiar to the art, is used for the actuation of tools and operations in the downhole environment. Limiting the relative movement between housing and mandrel (such that it is not possible or curtailed) until a threshold is reached allows control of the actuation. Once the threshold is reached, a release occurs and allows the relative movement between the housing and mandrel to initiate the actuation, whatever that might be. Further, it is to be understood that with the configuration 12 disclosed herein, the release is asymmetric. Specifically, the configuration 12 will release beyond a first threshold load when the mandrel 22 is loaded relative to the housing 20 in a first direction but will release at a second different threshold load when the mandrel 22 is loaded relative to the housing in a different direction to the first direction.

Figure 6A:
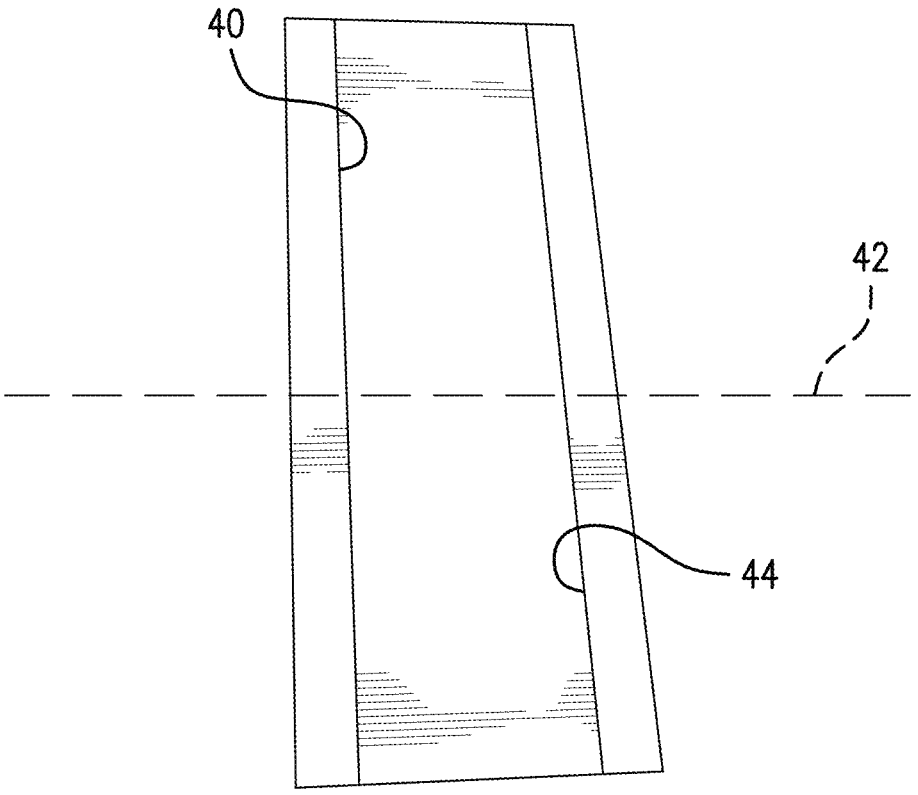
FIG. 6A illustrates an alternate layout for recesses.
Figure 7:
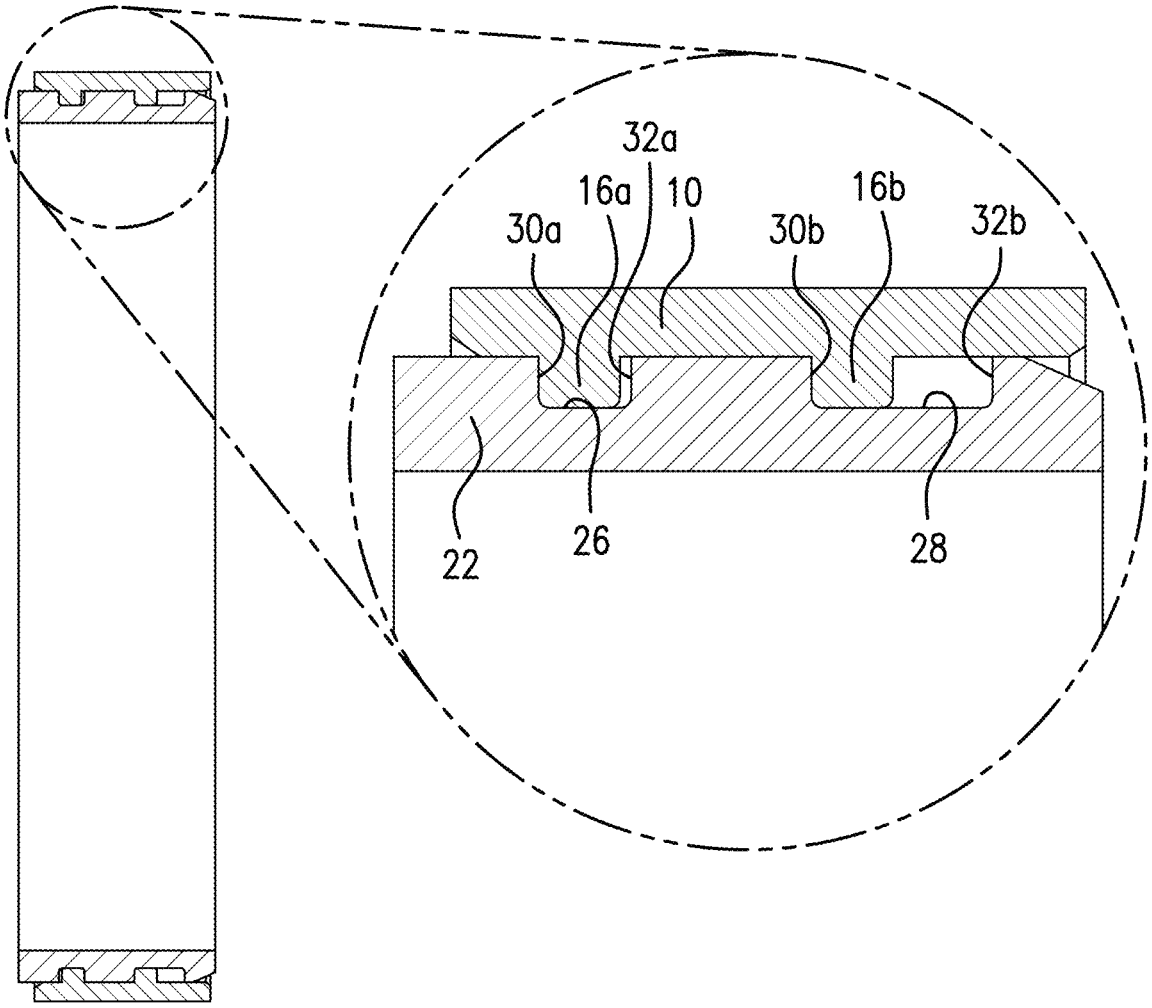
FIG. 7 is an enlarged view of the ovally scribed portion of FIG. 2 illustrating the asymmetric release device with load being applied in a first direction.
Figure 8A:
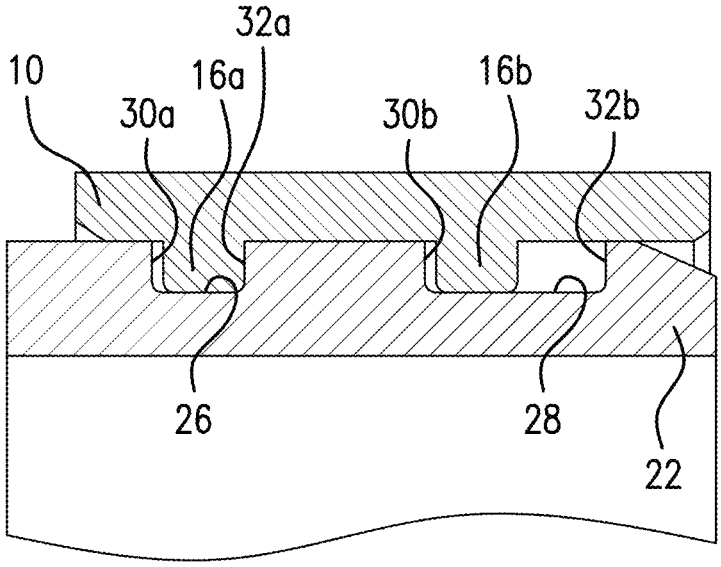
FIG. 8A is the view of FIG. 3 loaded in an opposite direction.
Figure 8B:
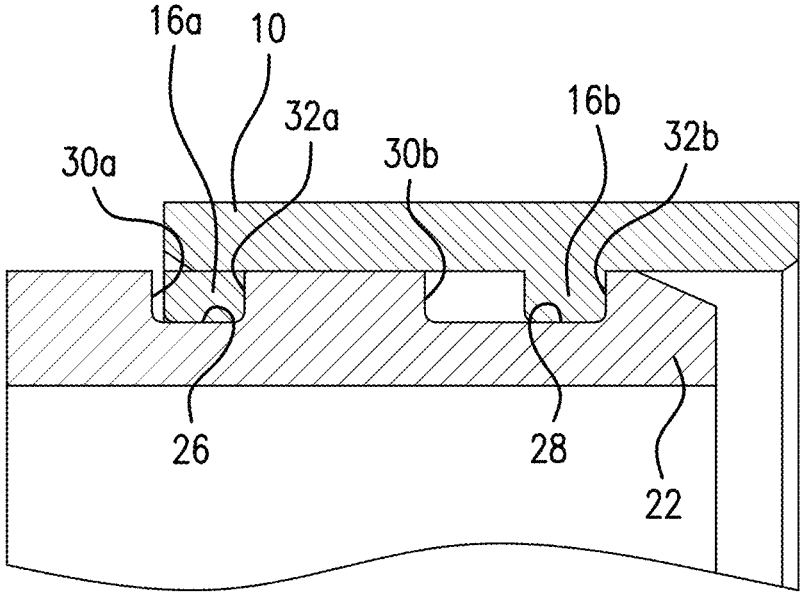
FIG. 8B is the view of FIG. 8A after a first projection has sheared leaving a second to contact another second shoulder.

Referring to FIGS. 7 and 8(A,B), body 10 is illustrated outwardly of the mandrel 22. It will be appreciated that in the embodiment illustrated, the body has two projections 16 extending inwardly of the body 10. This is not by way of limitation. It is merely one convenient embodiment to illustrate the operation of the device 12. The projections are labeled 16*a* and 16*b* for clarity. It will also be appreciated that the mandrel 22 exhibits two recesses 26 and 28. Projection 16*a* is engaged in recess 26 and projection 16*b* is engaged in recess 28. It will also be appreciated that the longitudinal dimension of recess 26 is similar to the longitudinal dimension of projection 16*a* while recess 28 defines a longitudinal dimension that is significantly larger relative to a longitudinal dimension of the projection 16*b*. The construction creates two first shoulders 30*a* and 30*b* and two second shoulders 32*a* and 32*b*. In FIG. 7, it can be appreciated that loading of the mandrel 22 toward the right side of the Figure causes both first shoulders 30*a* and 30*b* to contact projections 16*a* and 16*b* at the same time. Accordingly, with loading in this relative direction, both projections 16 must release (in shear, tension, bending, etc.) simultaneously to release the mandrel for relative movement. The threshold for this release is dictated by the load required for both of the projections 16*a* and 16*b* to release. This will be a relatively higher threshold in comparison to the opposite direction discussed immediately hereunder). FIG. 8A reverses the load (or otherwise changes its direction in some embodiments) such that the mandrel 22 is loaded leftwardly in the Figure relative to the body 10. It will be appreciated that second shoulder 32*a* makes contact with projection 16*a* while shoulder 32*b* does not make contact (at least initially) with projection 16*b*. Assuming for purposes of discussion but without intending limitation, if the projections 16*a* and 16*b* have identical release thresholds, then the direction of loading in FIG. 8A will have half the threshold for release as does the direction of loading in FIG. 7. The embodiment also gives the potential for a double actuation threshold since as is shown in FIG. 8B, further movement in the leftward direction of the Figure after the projection 16*a* allows shoulder 32*b* to contact projection 16*b*. The movement will again be impeded until the threshold is reached and projection 16*b*. From a practical point of view, the loads experienced downhole would require a larger longitudinal dimension in recess 28 to allow for the double actuation rather than simply a split action such that the threshold is half what it is in FIG. 7. This is simply because the loads involved are large and it is quite likely that in order to release 16*a*, the mandrel would move with enough energy to easily 16*b* some short time after 16*a* (likely microseconds). To be abundantly clear, "Release" as used herein includes but is not limited to shear, tensile, bending (plastic and elastic), etc. A release configuration is one that will hold until a threshold is reached and then allow movement and includes shear screws, collets, detents, etc. This disclosure facilitates those of skill to understand that there are a number of variations that are contemplated and within the scope of the invention. Different structures that provide for one or more shoulders that act simultaneously in one direction to give higher threshold values in that direction while causing a non-simultaneity in another direction (that might in some examples be the opposite direction) to give a lower threshold release are contemplated herein. This can be accomplished not only as illustrated in FIGS. 7 and 8 (A,B) but in other ways including by having a single recess that has a first shoulder 40 that is orthogonally oriented to a longitudinal axis 42 of the body while a second shoulder 44 is at an angle that is not orthogonal to the axis (see FIG. 6A); or a second shoulder having a saw toothed profile such that high points of the shoulder will contact the projection first thereby providing large stress risers when loaded in the second direction while the first shoulder distributes its load enabling a higher threshold in the first direction.

Figure 9:
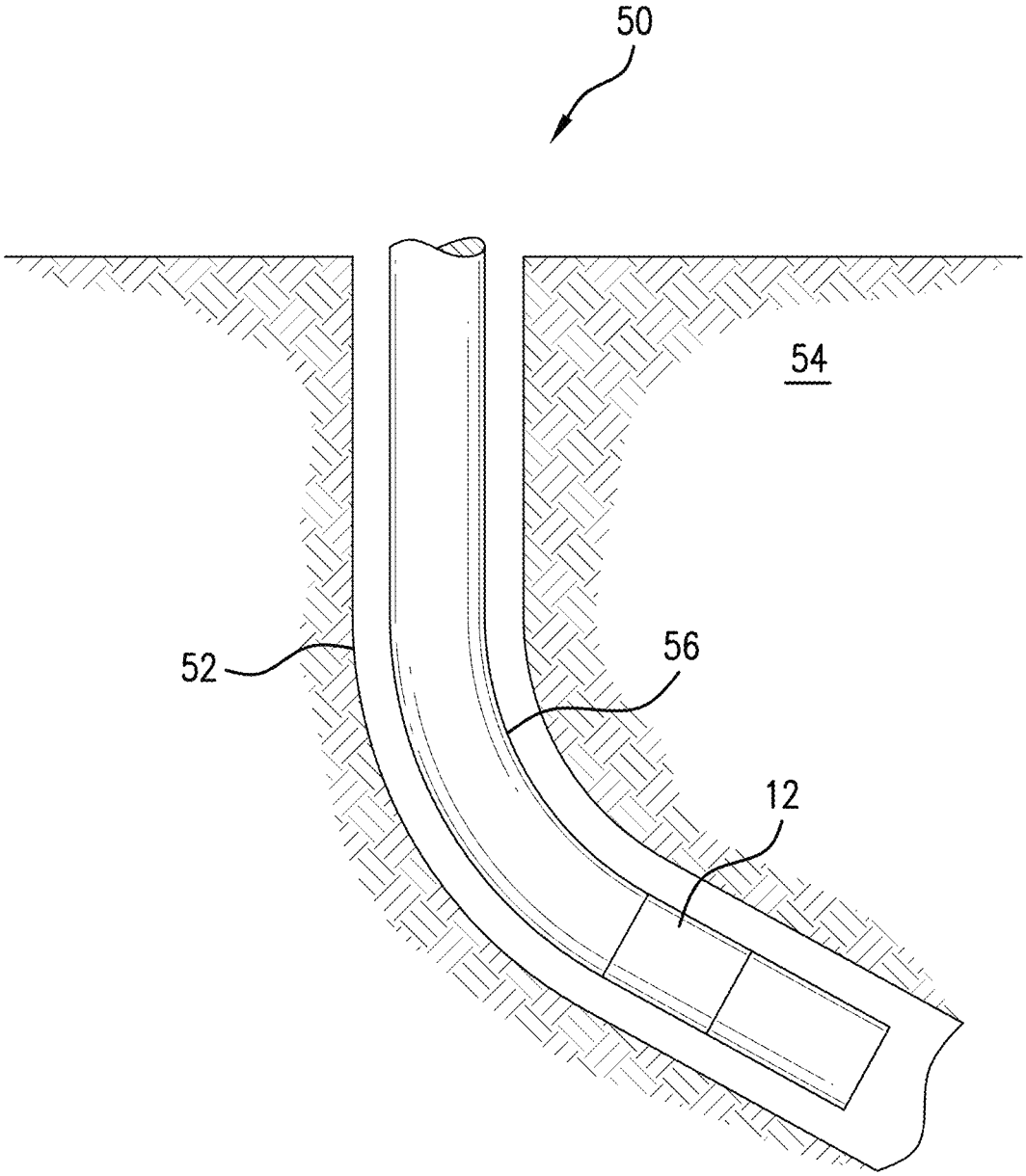
FIG. 9 is a view of a borehole system including the asymmetric release device as disclosed herein.

Referring to FIG. 9, a borehole system 50 is illustrated. The system 50 comprises a borehole 52 in a subsurface formation 54. A string 56 is disposed within the borehole 52. The asymmetric release device 12 as disclosed herein is a part of the string 56.

Set forth below are some embodiments of the foregoing disclosure:

Embodiment 1: An asymmetric release configuration including a projection, a recess receptive to the projection the recess having a first shoulder that when brought into contact with the projection in a first direction loads the projection in a first way that results in a first release threshold, and a second shoulder that when brought into contact with the projection in a second direction loads the projection in a second way that results in a second release threshold, the second release threshold being different than the first release threshold.

Embodiment 2: The configuration as in any prior embodiment wherein the projection is a plurality of projections and the first shoulder loads all of the plurality of projections simultaneously while the second shoulder loads the plurality of projections differently.

Embodiment 3: The configuration as in any prior embodiment wherein the plurality of projections are arranged about a periphery of the release configuration.

Embodiment 4: The configuration as in any prior embodiment wherein the periphery is annular or part annular.

Embodiment 5: The configuration as in any prior embodiment wherein the plurality of projections are arranged along a longitudinal extent of the configuration.

Embodiment 6: The configuration as in any prior embodiment wherein the differently is nonsimultaneously.

Embodiment 7: The configuration as in any prior embodiment wherein the second shoulder comprises a plurality of faces at least two of which are at different positions in the recess.

Embodiment 8: The configuration as in any prior embodiment wherein the second shoulder comprises a plurality of faces at least three of which are at different positions in the recess.

Embodiment 9: The configuration as in any prior embodiment wherein the second shoulder comprises a face that is non perpendicular to a longitudinal extent of the recess.

Embodiment 10: The configuration as in any prior embodiment wherein the recess is a plurality of recesses and the projection is a plurality of projections and wherein a first shoulder in each recess will simultaneously contact a respective one of the plurality of projections in a first direction while a second shoulder in each recess contacts fewer than all of the plurality of projections in a second direction.

Embodiment 11: The configuration as in any prior embodiment wherein the second shoulder in each of the plurality of recesses facilitates a plurality of sequential releases.

Embodiment 12: The configuration as in any prior embodiment wherein the plurality of recesses are arranged about a periphery of the release configuration.

Embodiment 13: The configuration as in any prior embodiment wherein the periphery is annular or part annular.

Embodiment 14: The configuration as in any prior embodiment wherein the plurality of recesses are arranged along a longitudinal extent of the configuration.

Embodiment 15: The configuration as in any prior embodiment wherein the recess is a part of a body receivable in a tubular of the configuration, the projection is a part of a body that is receivable in the tubular or both the recess and the projection are parts of respective bodies that are receivable in the tool.

Embodiment 16: The configuration as in any prior embodiment wherein at least one of the first release threshold and the second release threshold is a shear threshold.

Embodiment 17: The configuration as in any prior embodiment wherein the projection is a flange.

Embodiment 18: The configuration as in any prior embodiment wherein the flange is annular or part annular.

Embodiment 19: A borehole system including a borehole in a subsurface formation, and a configuration as in any prior embodiment disposed in the borehole.

Embodiment 20: A method for operating a borehole including running a configuration as in any prior embodiment into a borehole to a target depth, resisting a load on the configuration in a first direction to a first release threshold, and resisting a load in another direction to a second release threshold different than the first release threshold.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, installations of various pieces of equipment for the downhole environment that may be used for various contemporaneous or subsequent operations, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An asymmetric release configuration comprising:

an annular flange projection;

a recess receptive to the projection the recess having:

a first shoulder that when brought into contact with the projection in a first axial direction loads the projection in a first way that results in a first release threshold; and a second shoulder that when brought into contact with the projection in a second axial direction loads the projection in a second way that results in a second release threshold, the second release threshold being different than the first release threshold.

2. The configuration as claimed in claim 1 wherein the first shoulder loads all of the annular flange projection simultaneously while the second shoulder loads portions of the annular flange projection differently.

3. The configuration as claimed in claim 2 wherein a plurality of projections including the annular flange projection are arranged along a longitudinal extent of the configuration.

4. The configuration as claimed in claim 2 wherein the differently is nonsimultaneously.

5. The configuration as claimed in claim 2 wherein the second shoulder comprises a plurality of faces at least two of which are at different positions in the recess.

6. The configuration as claimed in claim 2 wherein the second shoulder comprises a plurality of faces at least three of which are at different positions in the recess.

7. The configuration as claimed in claim 1 wherein the anular flange projection extends from a periphery that is annular or part annular.

8. The configuration as claimed in claim 1 wherein the second shoulder comprises a face that is non perpendicular to a longitudinal extent of the recess.

9. The configuration as claimed in claim 1 wherein the recess is a plurality of recesses and a plurality of projections including the annular flange prois engage with vality of recesses and wherein a first shoulder in each recess will simultaneously contact a respective one of the plurality of projections in a first direction while a second shoulder in each recess contacts fewer than all of the plurality of projections in a second direction.

10. The configuration as claimed in claim 9 wherein the second shoulder in each of the plurality of recesses facilitates a plurality of sequential releases.

11. The configuration as claimed in claim 9 wherein the plurality of recesses are arranged about a periphery of the release configuration.

12. The configuration as claimed in claim 11 wherein the periphery is annular or part annular.

13. The configuration as claimed in claim 9 wherein the plurality of recesses are arranged along a longitudinal extent of the configuration.

14. The configuration as claimed in claim 1 wherein the recess is a part of a body receivable in a tubular of the configuration, or the annular flange projection is a part of a body that is receivable in the tubular or both the recess and the annular flange projection are parts of respective bodies that are receivable in the tool.

15. The configuration as claimed in claim 1 wherein at least one of the first release threshold and the second release threshold is a shear threshold.

16. A borehole system comprising:

a borehole in a subsurface formation; and a configuration as claimed in claim 1 disposed in the borehole.

17. A method for operating a borehole comprising:

running a configuration as claimed in claim 1 into a borehole to a target depth;

resisting a load on the configuration in a first direction to a first release threshold; and resisting a load in another direction to a second release threshold different than the first release threshold.

18. An asymmetric release configuration comprising:

a one-piece body, the body including a periphery and a projection extending from the periphery;

a recess receptive to the projection the recess having:

a first shoulder that when brought into contact with the projection in a first direction loads the projection in a first way that results in a first release threshold; and a second shoulder that when brought into contact with the projection in a second direction loads the projection in a second way that results in a second release threshold, the second release threshold being different than the first release threshold.

* * * * *